US005491861A

United States Patent [19]

Peñuela

[11] Patent Number: 5,491,861

[45] Date of Patent: Feb. 20, 1996

[54] PORTABLE, DEMOUNTABLE BRIDGE OF AERIAL POINT TO FORD RIVERS, CHASMS AND THE LIKE

[76] Inventor: Julio P. Peñuela, Transversal 3a. No. 87-15, Santa Fé de Bogotá, Colombia

[21] Appl. No.: 269,775

[22] Filed: Jul. 1, 1994

Related U.S. Application Data

[63] Continuation-in-part of Ser. No. 824,142, Jan. 22, 1993, Pat. No. 5,325,557.

[51] Int. Cl.[6] ..... E01D 15/12

[52] U.S. Cl. ..... 14/7; 14/2.4; 14/4

[58] Field of Search ..... 14/3, 4, 6, 7, 8, 14/13, 77.1, 2.4

[56] References Cited

U.S. PATENT DOCUMENTS

| | | | |
|---|---|---|---|
| 763,222 | 6/1904 | Van Driessche . | |
| 1,666,586 | 4/1928 | Wait . | |
| 2,417,825 | 3/1947 | Janke, Sr. . | |
| 3,027,633 | 4/1962 | Murphy . | |
| 4,651,375 | 3/1987 | Macchi . | |
| 5,072,474 | 12/1991 | Dilger et al. | 14/77.1 |
| 5,325,557 | 7/1994 | Penuela . | |

*Primary Examiner*—Ramon S. Britts
*Assistant Examiner*—James A. Lisehora
*Attorney, Agent, or Firm*—Beveridge, DeGrandi, Weilacher & Young

[57] ABSTRACT

A portable, demountable bridge which can be self-launched. The bridge uses a traditional beam system to conform the deck of the bridge. Two hollow, bottom-plated, triangular footings are added as supports for this beam. These footings, buried into the soil of a riverbank or the bank of a chasm, absorb the horizontal forces using the weight of the soil above the bottom plates of the footings. Sets of vertical plane trusses parallel to the axis of the deck and located on each side of the deck at the entrance, help the beam of the deck to support vertical loads, by means of a transversal truss which touches the beam of the deck at its upper chord. Each set of the additional vertical plane trusses are founded on two bottom plated footings buried into the riverbank or the bank of a chasm. The footing near the water uses the soil as a bearing, and the other footing is used as a counterweight. The bridge also uses the soil of the riverbank or bank of the chasm as a protection against floods. Preferably, all elements of the bridge are pin connected. The unions assure the theoretical requirements for obtaining simple stresses in the elements. The bridge is provided with U-shaped protection railings which use a spring, anchored to the deck, as a shock absorber.

7 Claims, 11 Drawing Sheets

PORTABLE, DEMOUNTABLE BRIDGE OF AERIAL POINT TO FORD RIVERS, CHASMS AND THE LIKE

CROSS REFERENCE TO RELATED APPLICATION

This application is a continuation in part of U.S. patent application Ser. No. 07/824,142 filed Jan. 22, 1992, now U.S. Pat. No. 5,325,557, which application is entirely incorporated herein by reference.

FIELD AND BACKGROUND OF THE INVENTION

This invention is related to bridges. The ultimate goals of an engineer in the design of a bridge are to create a structure which meets the area's demands, lasts the longest, and costs the least.

In recent years, engineers have developed portable bridges to cross short spans of no more than 200 feet. These portable bridges basically include a steel structure that includes a simple beam which crosses the span. Depending upon the loads carried by the beam, the structure is more or less light. The weight and maneuverability of the bridge also depend on the particular design employed.

There are several types of portable bridges, some of which use very well designed systems for forming the beam. Some of these bridges can be self launched using additional parts, while others need false work to be installed. In every instance, these bridges use vertical bearing walls as supports at both sides of the river, chasm or the like.

These bearing walls are buried into the soil as near to the water as possible, in order to shorten the length of the beam. These bearing walls are made of masonry or concrete and are affected by the water. In some cases, the whole bridge has failed because of the effect of floods on these bearing walls. Severe flooding can also separate the portable beam from these bearing walls, since the bridge is simply supported. Nowadays, as a result of the improvement of materials and design procedures, steel is used not only in the superstructure of bridges, but also in the deck and the foundations.

Cable bridges traditionally have used large concrete counterweights buried into the soil to absorb the force carried along the cables. Cable stayed bridges generally use the weight of the back part of the deck to equilibrate the vertical component of the force carried by the front stays, and the deck itself to absorb the horizontal component of the force in the back stays.

As discussed above, in the field of portable bridges, the system of a more or less light-weight simple beam that is assembled across the river supported by vertical bearing walls has been improved during the last years, although there is a need to develop other alternatives to make the bridge lighter and safer.

Statically determined trusses are among the most efficient structures for use in bridges. Therefore, bridges in accordance with the invention use trusses in all of their structural parts.

OBJECTIVES OF THE INVENTION

In general, it is an objective of the present invention to provide a method for portable bridge construction which does not need vertical bearing walls near the water to support the superstructure of the bridge.

Another objective of the invention is to provide a portable bridge system which uses the weight of the river bank soil as a structural element.

Another objective of the invention is to provide a portable bridge system, with the above characteristics, which uses the materials of the superstructure inclusive in the foundation.

Another objective of the present invention is to provide a portable bridge whose parts can be fully recovered for later use.

Another objective of the invention is to provide a portable bridge which replaces the bearing walls of the traditional beam for a pair of footings whose stability depends on the weight of the soil above it.

Another objective of the invention is to provide a portable bridge which adds a structure that takes advantage of the weight of the soil to help the traditional beam to support the vertical loads.

A further objective of the invention is to provide a portable bridge with a system that allows the division of the original span into various shorter spans.

Another objective of the invention is to provide a portable bridge in which the beam and its two footings absorb all horizontal loads, i.e., longitudinal and transverse loads.

Another objective of the invention is to provide a portable bridge where the additional structure only absorbs vertical forces produced by vertical loads, which vertical loads are the greatest in a bridge.

Another objective of the invention is to provide a portable bridge for short spans in which the additional structure comprises a set of triangular trusses, vertical and parallel to the main axis of the deck, on each side of the deck at one entrance of the bridge.

Another objective of the invention is to provide a portable bridge which uses, for longer spans, the system mentioned before, but on each of the bridge entrances.

Another objective of the invention is to provide a portable bridge in which these additional structures, which are separate from the beam and footings, work like a statically determined truss. The bridge in accordance with the invention is designed such that it nearly complies in all cases to the theoretical requirements, such as being axially stressed.

Another objective of the invention is to provide a portable bridge in which the additional structure, formed by a truss, allows the forces that are carried by the elements to annul themselves in the unions, especially the forces carried by the horizontal elements of the trusses. This allows for the soil to be stressed by this additional structure only in a vertical direction.

A further objective of the invention is to provide a portable bridge with two additional footing structures. One footing acts as the counterweight, and the other footing acts as a bearing to conform a couple of forces that equilibrate the principal loads of the bridge.

Another objective of the invention is to provide a portable bridge in which the unions of the entire bridge are hinged using pins or screws, in order to facilitate the tying and untying of the parts and to accomplish the theoretical requirements of plane trusses.

Another objective of the invention is to provide a portable bridge in which all the main elements, except the horizontal elements of the additional structure, are submitted to simple stresses, that is, the main elements are either in tension or compression along their axes.

Another objective of the invention is to provide a portable bridge in which the additional structure is in contact with the beam and footing system to give it only vertical support.

Another objective of the invention is to provide a portable bridge that can be self-launched, avoiding the use of false work.

Another objective of the invention is to provide a portable bridge which is completely hinged so that if the soil settles over time, the structure may lose its original geometry, but will continue to work.

Another objective of the invention is to provide a portable bridge which uses some elements as support for the bracing of other elements, especially the horizontal members of the additional trusses.

An additional objective of the invention is to provide a portable bridge in which the simple beam used for the deck of the bridge is conformed by longitudinal trusses that clear the entire span and the necessary bracing elements that assure stability against horizontal forces parallel to the river.

Another objective of the invention is to provide a portable bridge whose footings are buried in the dry land of the riverbank and which uses the soil between the footing and the water as protection for the footing.

Another objective of the invention is to provide a portable bridge whose footings are protected from flood by the soil above them.

Another objective of the invention is to provide a portable bridge which uses a shock absorbing system as protection rails.

Additional objects and features of the invention will become apparent from the following description in which the preferred embodiment has been set forth in detail, in conjunction with the accompanying drawings.

DESCRIPTION OF THE PREFERRED EMBODIMENT

The preferred embodiment of the invention relates to a portable bridge that uses steel hollow tubes, steel pins, steel nuts and bolts, and steel brackets as materials. These materials are combined with concrete posts for footings and wood for the deck. It is understood that materials other than these may be used.

Figure 1:
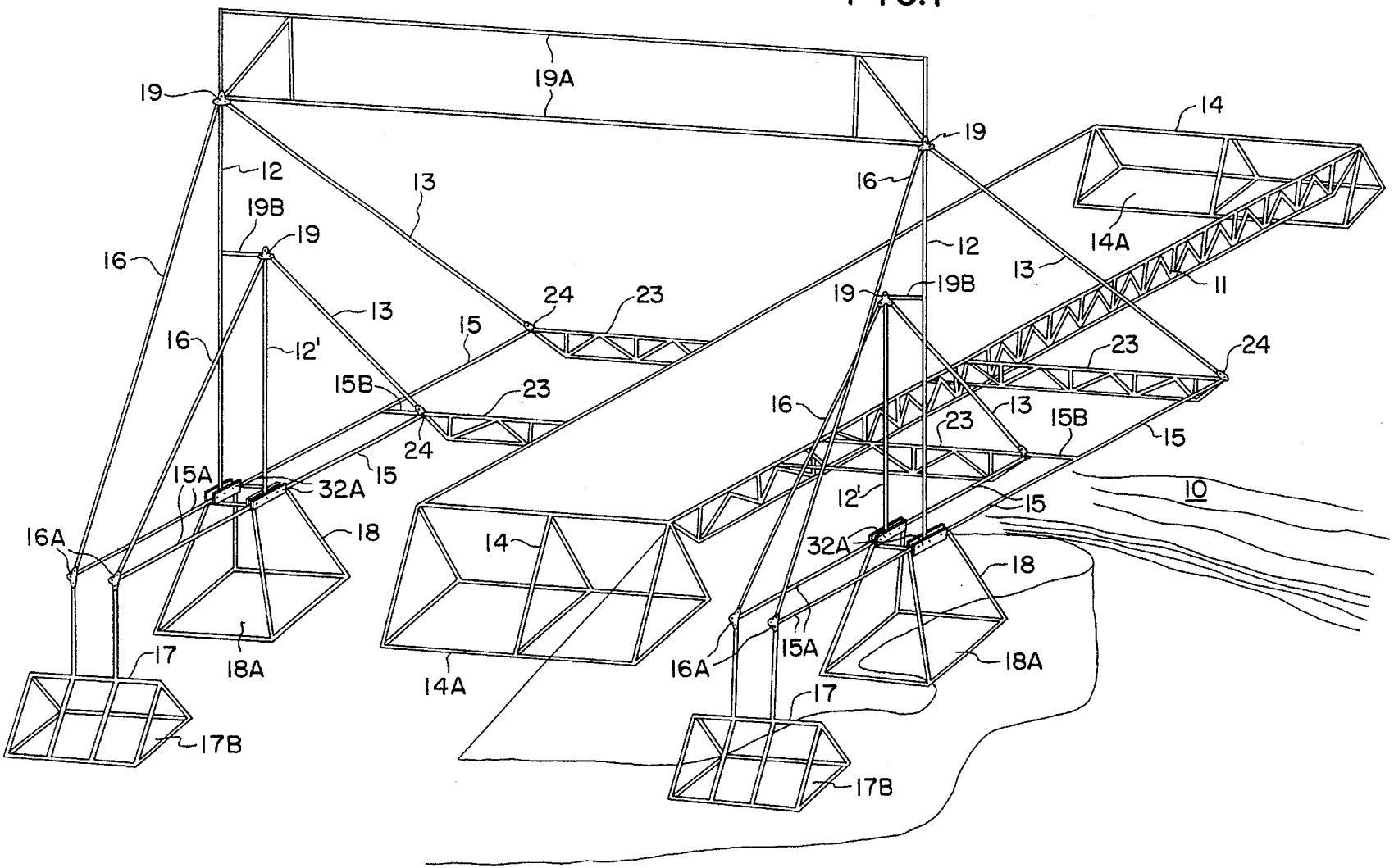
FIG. 1 is an isometric view of the short span version of the portable bridge that uses the additional structure only on one side of the river.

FIG. 1 shows the model of bridge installed across a short span of no more than 30 meters. Numeral 10 indicates the river, chasm or the like being forded by the bridge. Numeral 14 indicates the triangular footings for the bridge.

Numeral 14A indicates the slab of the footing. This slab is formed of concrete posts tied to the interior part of the footing (14) and placed side by side to form a slab. This same principle is used in the slabs (17B) of footings (17) and slabs (18A) of footings (18).

Slab (14A) is used to receive the weight of the soil directly above it. This portion of soil gives stability against horizontal forces to the system formed by the deck (11) and the footings (14).

It can also be seen in FIG. 1 that the additional structure is formed by elements (15A, 16, 13, 15), and (12). Each of the triangular trusses acts independently of the other in its own plane while having the same bearing footing (18) and the counterweight (17) on each side of the deck in common. Additionally, the vertical element (12) is used as support for the bracing (19B) that gives stability to the vertical element or pole (12).

Element (15B) is an additional part of the first transversal truss (23) which braces the longest horizontal element (15).

The higher trusses are connected by the elements (19A) which are braces that permit differential settlements of the two footings (18). It should be noted that the system formed by the deck (11) and the footings (14) is connected to the additional structure by the transversal trusses (23). These trusses are supported by the union (24) which is also called the AERIAL POINT in this specification. These transversal trusses serve as the union of the superior chords of longitudinal trusses that conform the deck. A more detailed explanation will be given when referring to FIG. 3.

These transversal trusses then act as simple vertical supports of the deck, thus dividing the original span into three shorter spans. The horizontal forces carried by the elements (15) and (15A) annul themselves in union (32A). Because all horizontal loads are being absorbed by the deck (11) and the footings (14), it is recognized that footing (18) is only stressed in a downward direction. Because element (15A) absorbs the horizontal component of the force carried by the stay (16), the counterweight (17) is only stressed in an upward direction.

Figure 2A:
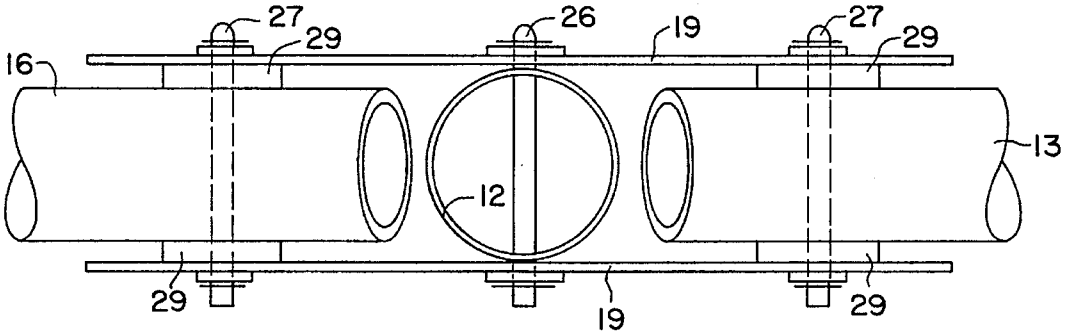
FIG. 2A is a top view of the union between the vertical element of the additional structure and the front and back stays.
Figure 2B:
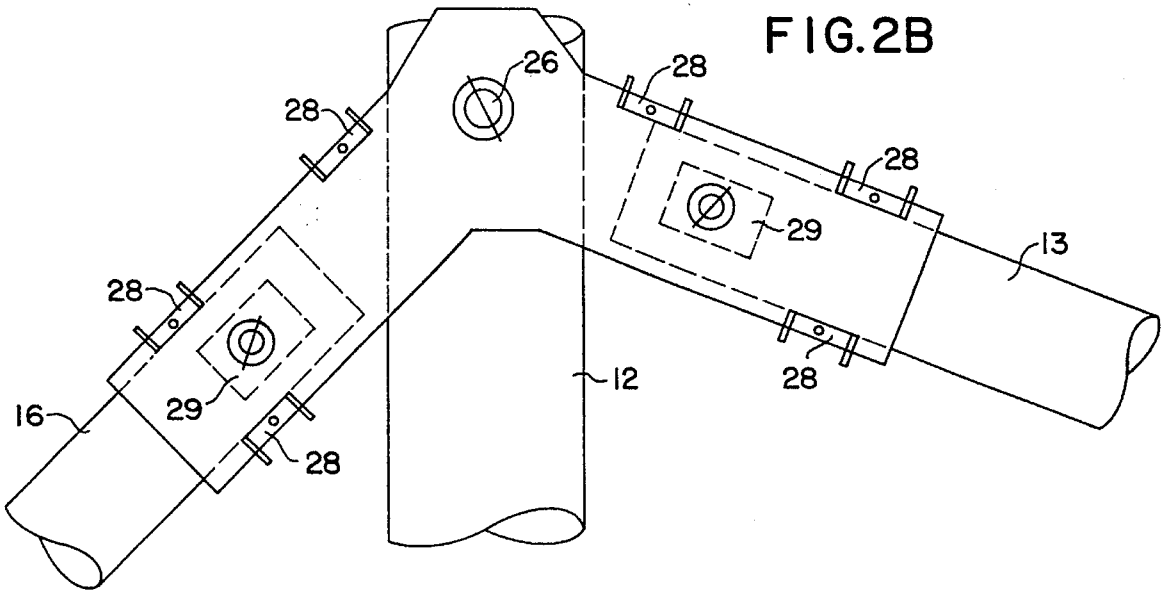
FIG. 2B is a side view of FIG. 2A.

FIG. 2A shows a top view of the union located in the upper extremity of the vertical element of the additional trusses. The union is formed by two brackets (19) on each side of the vertical element (12) and parallel to the principle plane of the additional structure. These brackets have the shape shown in FIG. 2B, which is a side view of the union.

These brackets are provided with three holes which permit the pins (27, 26) to pass through the brackets and through the corresponding holes on the pole (12).

The two brackets are provided with the elements (28), which are blocks of steel with a hole concentric with a hole in the bracket. The elements (28) are welded to the bracket. The purpose of these blocks is to assure simple shear in the pins (27) without bending the pins, in the case where the diameter of the pole (12) is greater than the stays (13, 16). The elements (28) serve for maintaining the geometry of the union.

Figure 3:
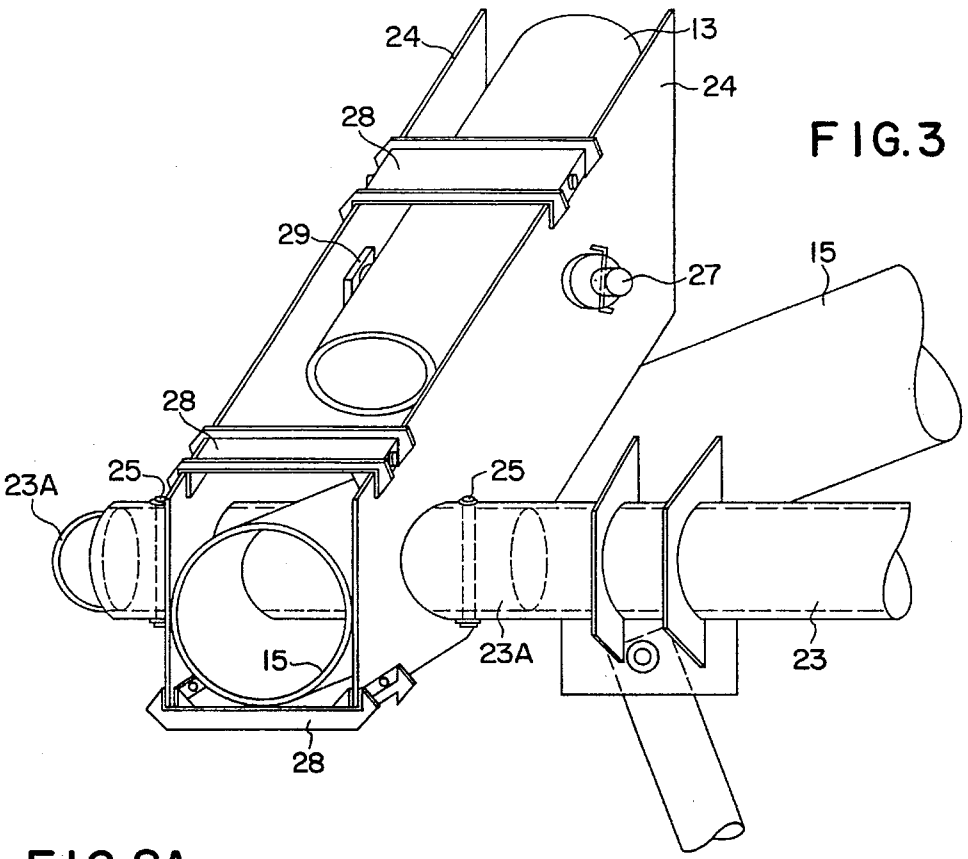
FIG. 3 is an isometric view of the union between the additional vertical truss and the transversal truss.
Figure 3B:
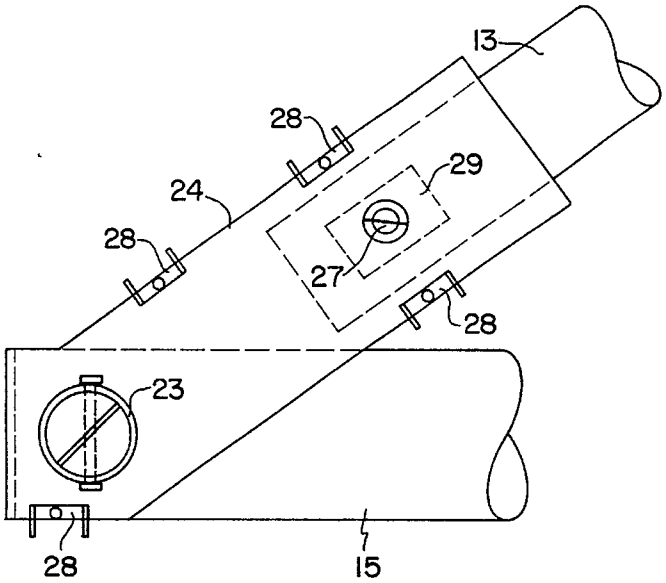
FIG. 3B is a side view of FIG. 3.
Figure 3C:
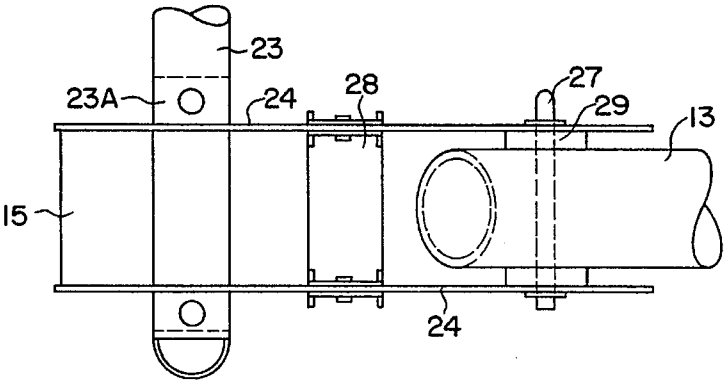
FIG. 3C is a top view of FIG. 3.
Figure 3A:
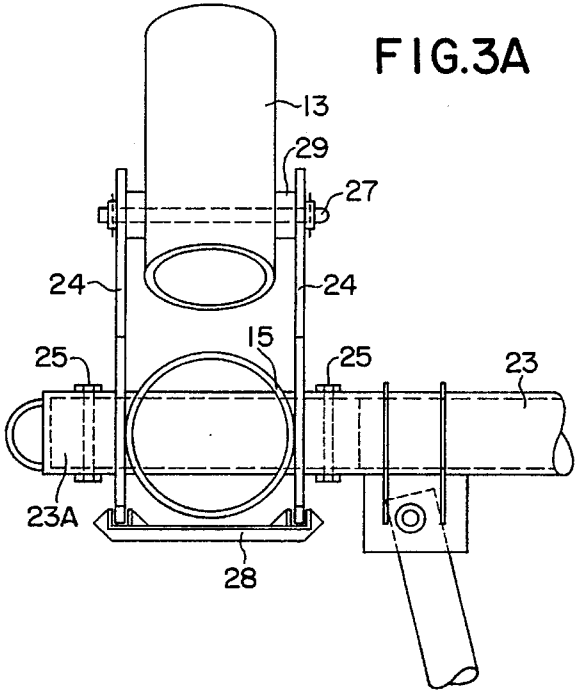
FIG. 3A is a front view of FIG. 3.
Figure 3D:
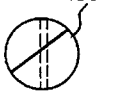
FIG. 3D and 3E are additional views of the solid bar element of FIG. 3C.
Figure 3E:
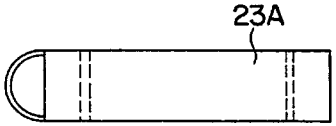

FIGS. 3–3E show views to illustrate the union between the vertical trusses which conform the additional structure and the transversal trusses (23) that give support to the deck (11), dividing the original span into three shorter spans. Union (24) is formed from two brackets provided with two holes and having the shape shown in FIG. 3B, which is a side view of union (24). This union (24) is also called the AERIAL POINT.

One hole permits the installation of pin (27) which connects the stay (13) with the union (24). The other hole, which is much bigger, permits the connection of union (24) with transversal truss (23).

FIG. 3 shows that the superior chord of the transversal truss (23) passes through the brackets (24) and through the horizontal element (15).

Element (23A) fits exactly inside the tube that forms the superior chord of the transversal truss, being a solid bar provided with two holes and a handle. These holes permit bolts (25) to get in position. This solid bar (23A) is used for absorbing the shear forces produced by the brackets and the horizontal elements (15). The handle is used to easily put the solid bar (23A) in position and to retire it in case of disassembly of the bridge. Elements (28) described below serve to maintain the geometry of union (24).

Figure 4:
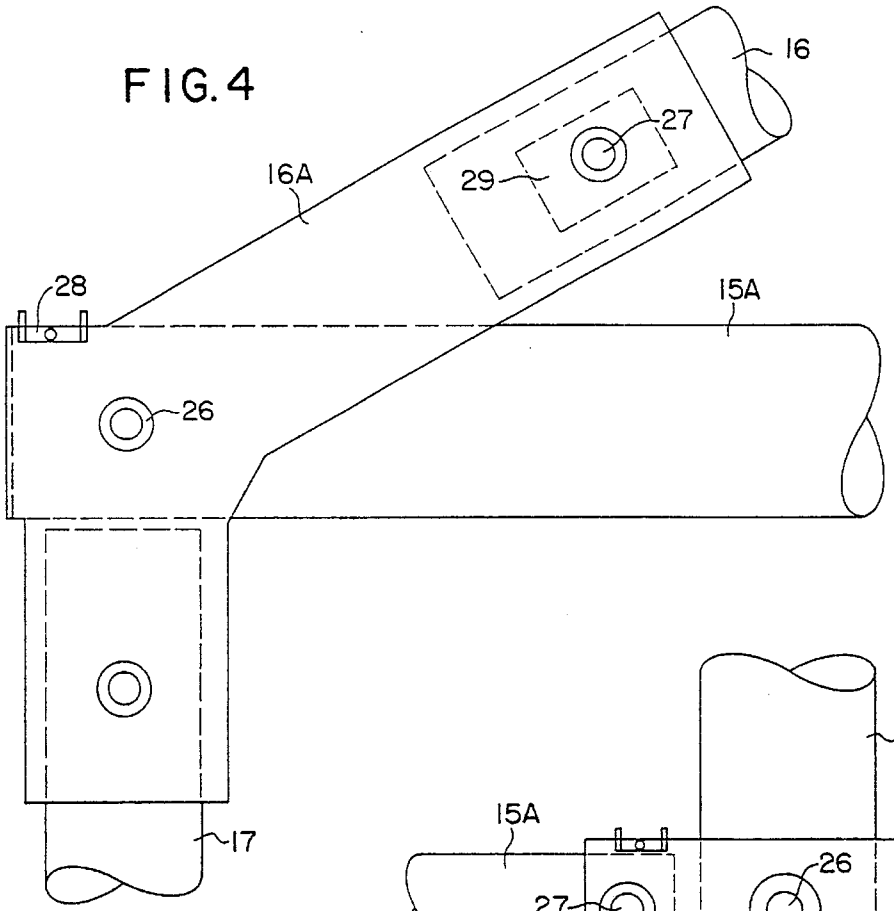
FIG. 4 is a lateral view of the union between the additional truss and the counterweight.

FIG. 4 shows a lateral view of the union (16A). It is conformed by two brackets with the shape shown. The brackets have three holes that serve to connect the stay (16) by means of a pin (27), through the interior another pin passes that connects the union (16A) with the counterweight (17).

Figure 5:
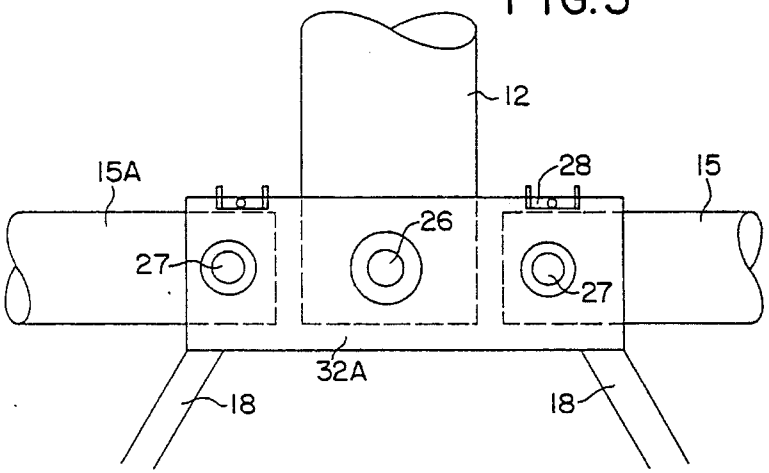
FIG. 5 is a side view of the union between the horizontal elements of the additional trusses and the vertical element or pole.

FIG. 5 shows a side view of the union (32A) which connects the two horizontal elements (15, 15A), and the vertical element or pole (12). The union includes two parallel brackets with three holes in each one. The back hole receives a pin (27) that connects the horizontal element (15A). The front hole does the same for pin (27) that connects to element (15).

The center hole permits pin (26) to connect to the vertical element or pole (12). The front hole is located to allow the rotation of the horizontal element (15) without touching any part of the union. This is a very important feature since it permits the launching of the bridge. The proposed system of launching first installs horizontal element (15) in a vertical position and then allows it to rotate around the pin (27) until stay (13) can be connected to union (19). For this launching, during the rotation, element (15) will be held by temporary stays.

Figure 1A:
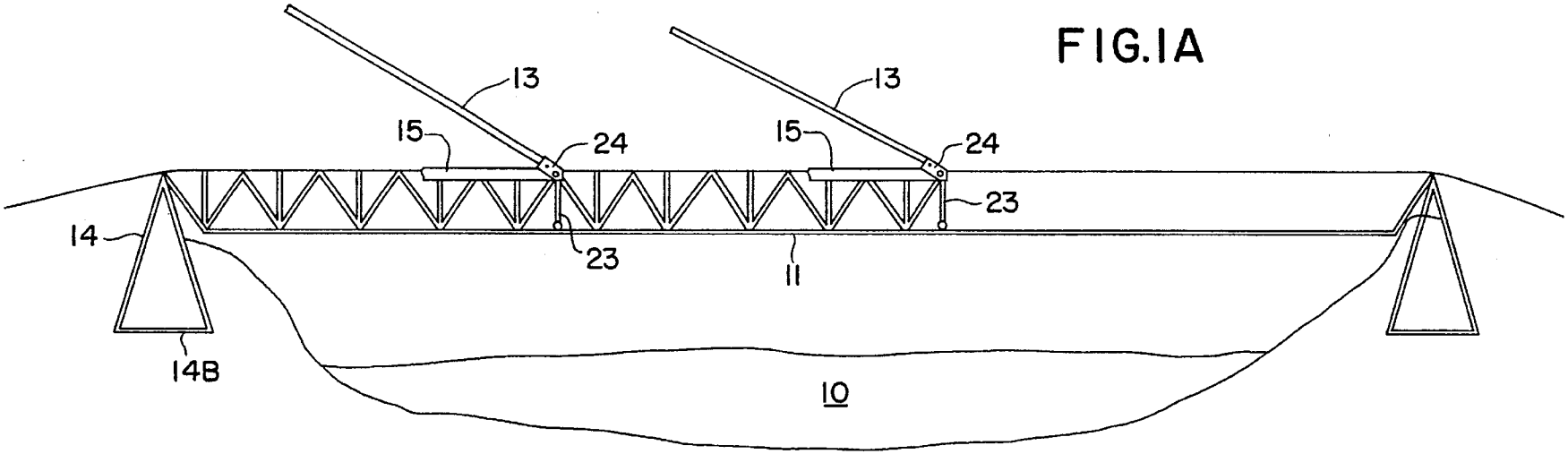
FIG. 1A is a side view of the beam and footings system showing how this beam and footing system combines with the additional structure of the bridge.

FIG. 1A is a side view of the beam that forms the deck with the two triangular footings (14) connected to the beam (11) and buried on each side of the river.

FIG. 1A also shows the transversal trusses (23) connected by means of union (24) and by stays (13). It can be seen that the transversal trusses (23) only touch the beam of the deck in two distinct points. It can also be seen that the soil directly above the bottom plate (14A) will absorb the breaking forces produced by vehicles on the deck.

Figure 1B:
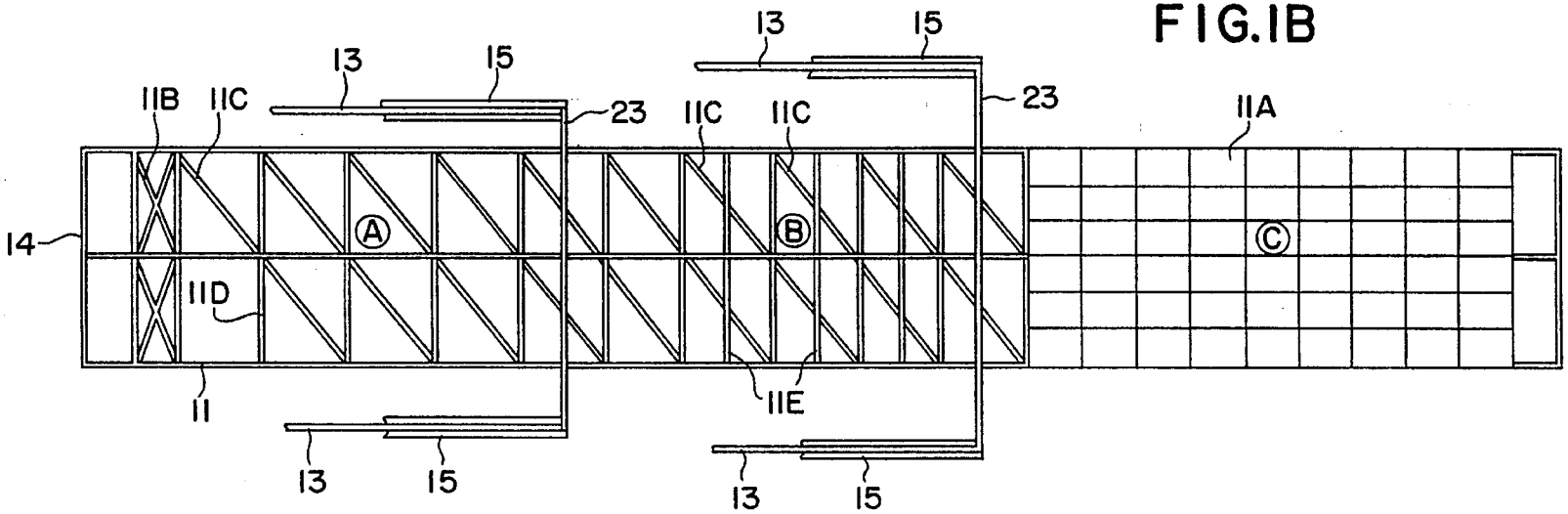
FIG. 1B is a top view of FIG. 1A.

FIG. 1B is a top view of FIG. 1A and shows three steps in the assembly of the deck. In the left part (A) of FIG. 1B, between footing (14) and the first transversal truss (23), one can see the longitudinal trusses (11) connected by the horizontal elements (11C, 11D).

FIG. 1B also shows the transversal trusses (23), maintained in place by stays (13) and the horizontal element (15), touching the deck only with the superior chord of the transversal trusses (23). It can be seen also that the stays (13) and the horizontal element (15) do not touch the deck; thus accomplishing the requirement that the beam and footing system absorbs horizontal forces and that the additional structure only works against vertical forces. It must be noted that the interior chord of the transversal trusses (23) remains above the interior chord of the longitudinal trusses (11) without touching them.

Figure 1C:
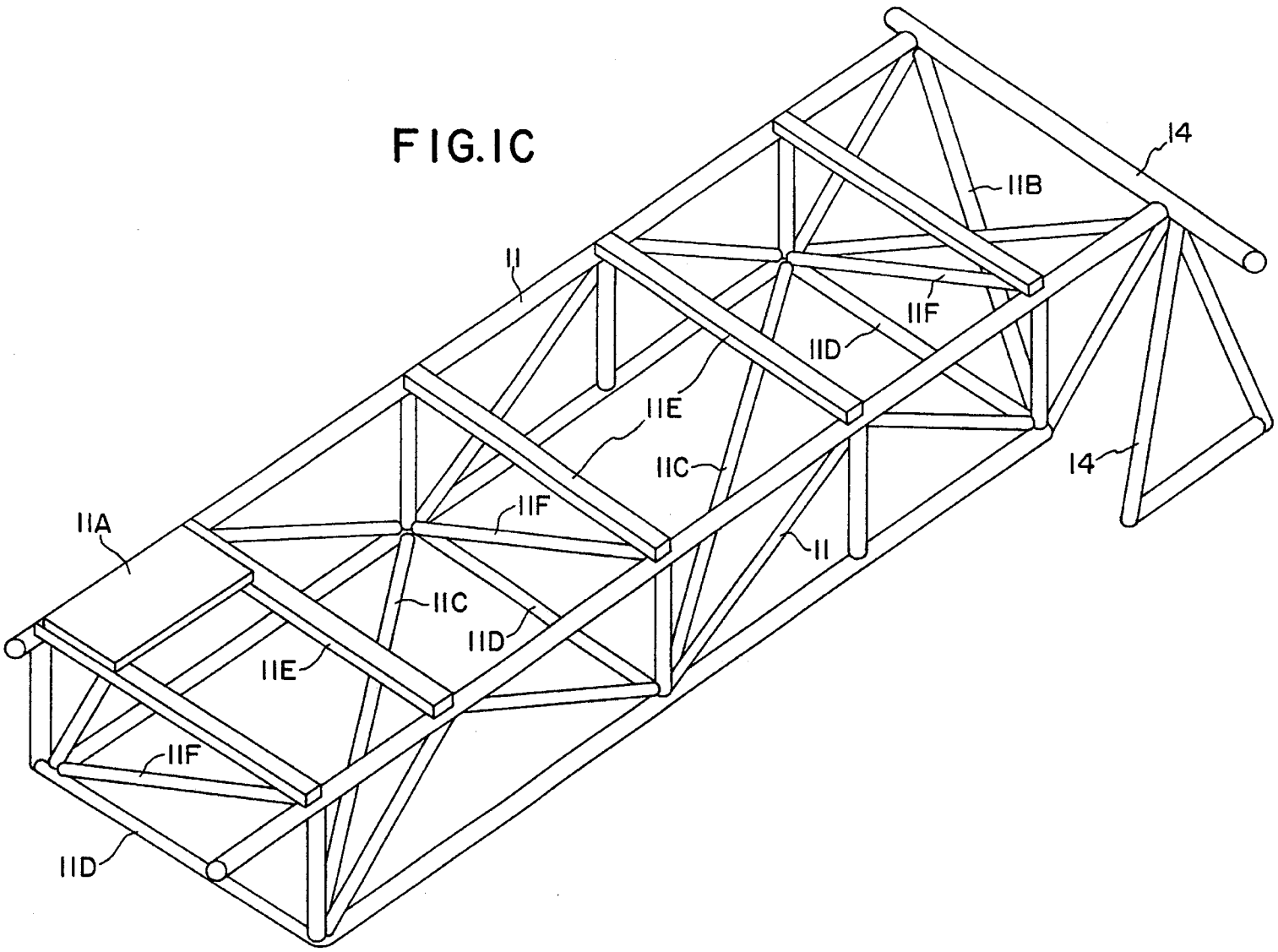
FIG. 1C shows an isometric view of the structural elements of the deck.

FIG. 1B also shows three steps in the assembly of the deck. In the left part of the FIG. 1B, the longitudinal trusses have already been installed. The elements (11D, 11C) have also been installed. In zone B, the elements (11E) that directly support the wood of the deck have already been installed. In zone C, the wooden deck (11A) has already been installed, and the deck is ready to allow for the passage of vehicles. It must be noted that the elements (11) located exactly below the transversal trusses (11) do not touch these trusses. In the inclined plane that reaches from the extremity of the interior chord to the corresponding extremity of the deck, elements (11B) are placed to complete the beam of the deck. This is shown in FIG. 1C.

Figure 6B:
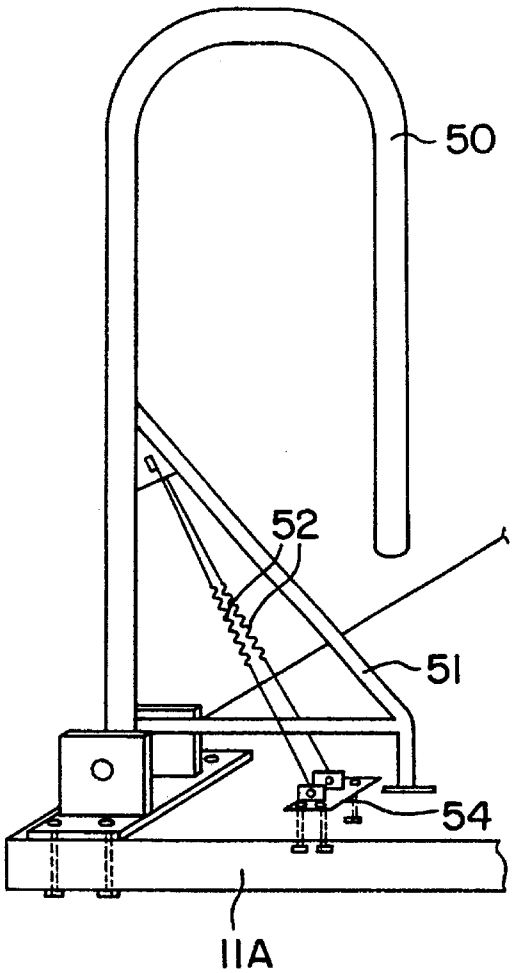
FIGS. 6A and 6B are isometric views of the protection railings of bridge.
Figure 6A:
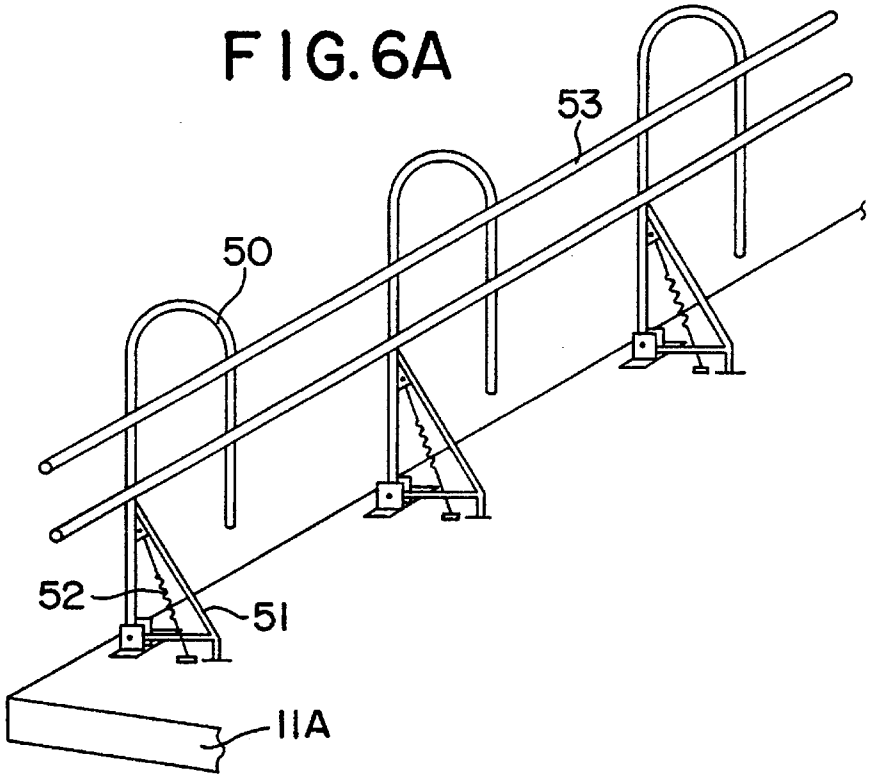

FIGS. 6A and 6B illustrate isometric views of the protective railings of the bridge. Element (50) is a U-shaped tube provided with element (51), which forms a triangle which acts as a footing for the railing. Underneath element (51), a high resistant spring (52) connects to the wooden portion of the deck by means of element (54), and also to the U-shaped tubing. This spring (52) is used as a shock absorber.

Figure 8C:
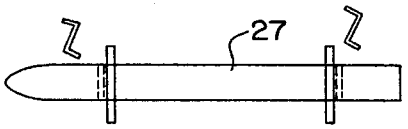
FIGS. 8A to 8C are views of the elements used to maintain the geometry of the unions.
Figure 8B:
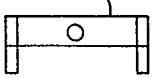
Figure 8A:
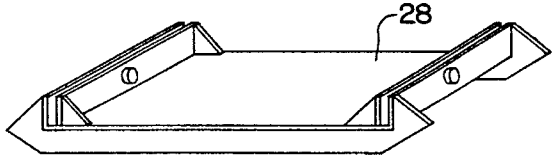

FIGS. 8A to 8C illustrate the device used to maintain the geometry of the unions in the additional structure. This device includes a rectangular plate with two foldings, parallel to the principle axis of the plate, and two pair of plates welded on each extremity of the plate. These welded plates have a concentric hole which allows a screw to pass through to the corresponding hole previously made on the brackets of the unions.

Figure 1D:
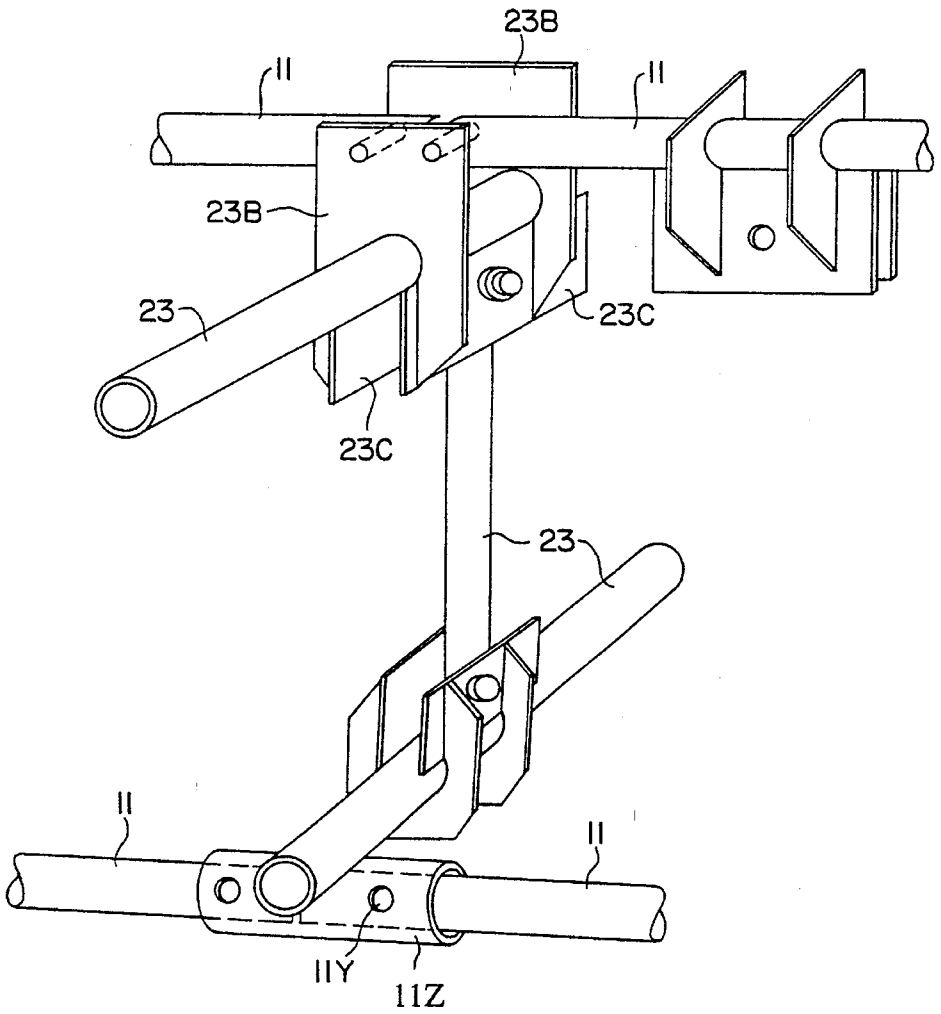
FIG. 1D is an isometric view of the connection between the transversal truss and the deck.

FIG. 1D demonstrates an isometric view of the connection between the transversal truss (23) and the longitudinal trusses (11). The upper connection is made by means of the shaped brackets (23B) which are a part of transversal truss (23). These brackets have holes which permit screws to assemble the two portions of the longitudinal truss (11). It should be noted that these holes permit truss (11) to rotate around the screw without touching other parts of the bridge.

In the lower section of the connection, the two aligned portions of the truss (11) are assembled by means of union (11Z) which is a portion of tubing whose diameter is larger than the tubing of the lower chord. This piece of tubing is provided with holes that allow the screws (11Y) to assure the continuity of the chord. It must be noted that transversal truss (11) while giving vertical support, is only in contact with the longitudinal truss at the shaped brackets (23B).

The system shown in FIG. 1D uses parallel shaped brackets transverse to the principle axis of the truss. These brackets are welded to another pair of brackets parallel to the chord of the truss. These last brackets are provided with holes that allow the assembly of the diagonal and vertical elements of the truss. It should be noted that this system is used throughout the bridge.

FIG. 1C shows an isometric view of the system used for forming the deck of the bridge. The unions have not been drawn. This figure shows the position of the structural elements needed to obtain the desired stability of the beam.

METHOD FOR LAUNCHING

Figure 7C:
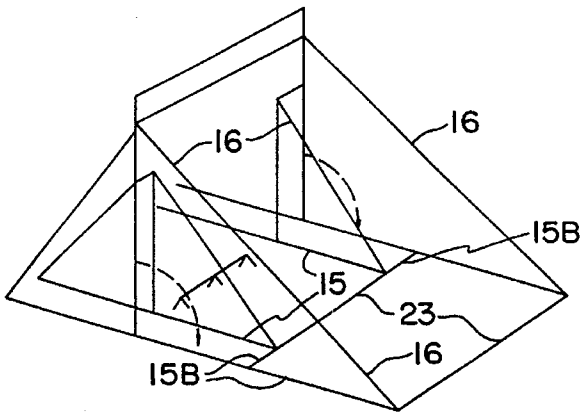
FIGS. 7A to 7F show the proposed method of launching the bridge.
Figure 7B:
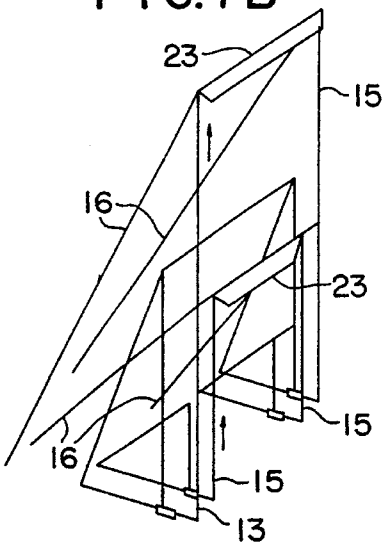
Figure 7A:
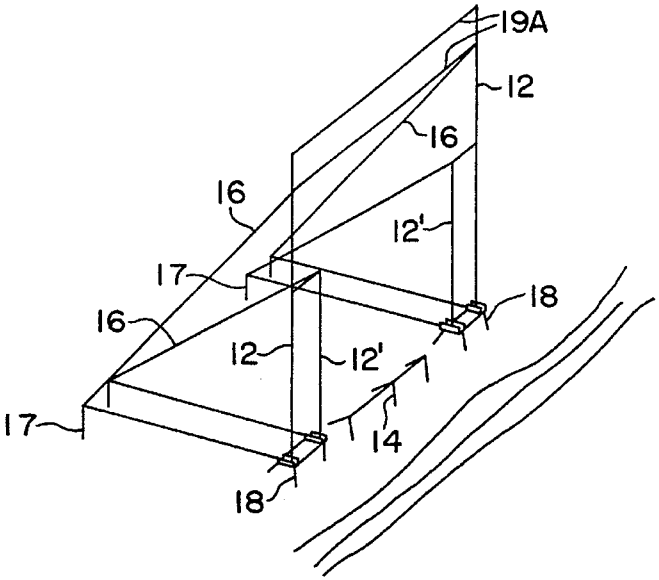

FIG. 7A shows an isometric view of the first step in the launching the bridge. Footings (14, 17, 18) have already been buried in the soil of the riverbank and poles (12), horizontal elements (15A) and the back stays (16) have been connected by means of the corresponding units. The bracing element (19A) has also been put in place. It should be noted that all of this work has been completed in the dry portion of the riverbank.

FIG. 7B shows the second step in the launching process. Horizontal elements (15) have been placed vertically and are connected by the corresponding pin (27) to the union (32). Being in that position, the transversal trusses (23) are raised to the upper extremities of elements (15) and are connected by means of the unions (24). The front stays are connected to the unions (24) thus having one extremity connected to union (24) and the other extremity resting on the ground.

FIG. 7C demonstrates the third step in launching. By means of ropes as temporary stays, the horizontal element (15) and the transversal truss (23) connected to union (24) pivot from their vertical position to their definitive position.

Figure 7E:
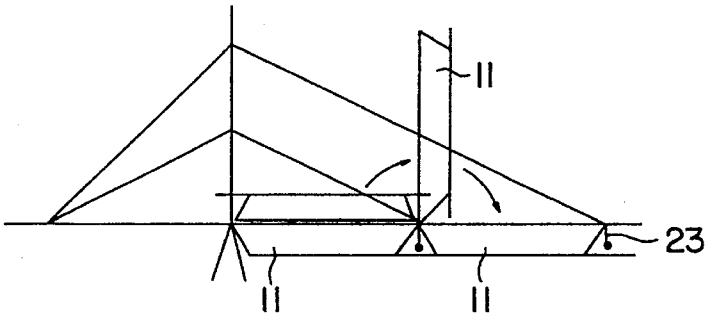
Figure 7F:
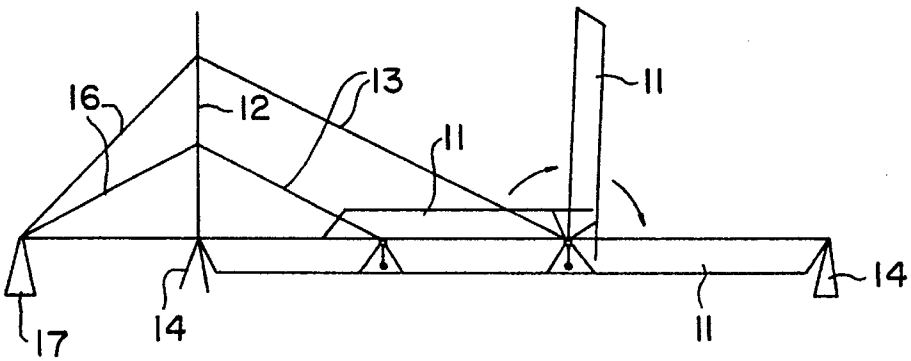
Figure 7D:
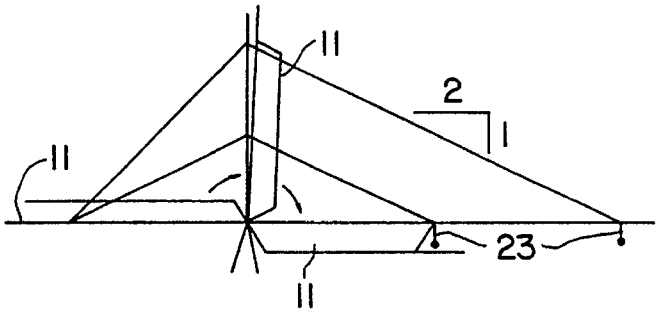

FIG. 7D shows the fourth step in the launching of the bridge. The first portion of the longitudinal trusses (11) is assembled and placed with the corresponding extremity and is tied to the upper chord of footing (14). The truss is then rotated until the corresponding extremity is connected to the transversal truss (23). This operation is repeated with each transversal truss. Elements (11B, 11C, 11D, 11E, 11F) are then connected to the longitudinal trusses (11) to form the first portion of the deck, and the wooden portion of the deck is then assembled.

FIG. 7E demonstrates the next step in the launching process. The operation shown in FIG. 7D is repeated with the following portion of the deck.

FIG. 7F shows the operation described earlier, but performed with the final portion of the deck. It should be noted that all trusses, that is the transversal truss (23) and the longitudinal trusses (11), do not have all of their elements when lifted or rotated. To avoid working with large loads, using the system of unions shown in FIG. 1D, the trusses can be totally assembled after being connected to the corresponding union.

While the invention has been described in terms of specific, preferred embodiments, those skilled in the art will recognize that various modification and changes can be made without departing from the spirit and scope of the invention, as defined in the appended claims.

I claim:

1. A portable demountable bridge for fording a river or chasm, comprising:

a deck which crosses an entire span of the bridge;

two bottom plated footings supporting said deck, one footing located at each end of said deck, each of said footings being buried into the soil at a point spaced from the river or chasm, such that the soil located directly above said footings absorbs horizontal forces on the deck;

at least two vertical trusses, one on each side of said deck, located at an entrance of the bridge, said vertical trusses being parallel to a principle axis of the said bridge;

a transversal truss connecting said vertical trusses and supporting said deck; and a foundation structure, said foundation structure including two footings buried in the soil at separate locations, the first footing being located closer than the second footing to the river or chasm being crossed and below the vertical trusses, said first footing being used as a bearing, and the second footing being located further than the first footing from the river or chasm being crossed and utilizing the soil above it as a counterweight, wherein said vertical trusses include a common bracing which permits differential settling of said first footing.

2. The bridge of claim 1, further comprising parallel brackets for connecting the vertical trusses to the first footing and to a horizontal component of the foundation structure, said brackets being connected to the vertical trusses, first footing, and horizontal component by pins to facilitate the assembly and disassembly of said bridge and to insure the maintenance of simple stresses in the foundation.

3. The bridge of claim 1, wherein the two bottom plated footings and the first footing and second footing are buried in a dry part of a riverbank, whereby soil above the footings is used as protection against severe floods.

4. The bridge of claim 1, wherein the foundation structure includes completely hinged, statically determined trusses which allow for settling of the first footings without introducing stresses onto the vertical trusses.

5. The bridge of claim 1, further including a protective railing along the deck.

6. The bridge of claim 5, wherein the protective railing includes at least two U-shaped elements connected by a horizontal element.

7. The bridge of claim 5, wherein the U-shaped elements include a base element for stability and a U-shaped bar, and a spring connecting the U-shaped bar and the base element.

* * * * *